US006196651B1

(12) United States Patent
Zuber et al.

(10) Patent No.: US 6,196,651 B1
(45) **Date of Patent: *Mar. 6, 2001**

(54) METHOD AND APPARATUS FOR DETECTING THE END OF LIFE OF A PRINT CARTRIDGE FOR A THERMAL INK JET PRINTER

(75) Inventors: Marilyn Louise Zuber, Shedd; Donald L. Michael, Monmouth; Susan A. Chavez; Nancy Leigh Herald, both of Corvallis; Brian L. Helterline, Salem, all of OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,013

(22) Filed: Dec. 22, 1997

(51) Int. Cl.[7] ..... B41J 2/195; B41J 29/393
(52) U.S. Cl. ..... 347/7; 347/19
(58) Field of Search ..... 347/7, 19, 14, 347/85, 86, 87

(56) References Cited

U.S. PATENT DOCUMENTS

| | | | | |
|---|---|---|---|---|
| 4,326,199 | | 4/1982 | Tarpley et al. | 340/622 |
| 5,315,316 | * | 5/1994 | Khormaee | 347/19 |
| 5,655,174 | * | 8/1997 | Hirst | 347/19 |

(List continued on next page.)

FOREIGN PATENT DOCUMENTS

| | | |
|---|---|---|
| 0444861 A2 | 9/1991 | (EP) . |
| 0569201 A1 | 11/1993 | (EP) . |
| 0606017A2 | 7/1994 | (EP) . |
| 0709208 A1 | 5/1996 | (EP) . |
| 0744296 A1 | 11/1996 | (EP) . |
| 0878308 A2 | 11/1998 | (EP) . |
| 08252926 | 10/1996 | (JP) . |

*Primary Examiner*—John Barlow
*Assistant Examiner*—Juanita Stephens
(74) *Attorney, Agent, or Firm*—Curtis G. Rose

(57) ABSTRACT

A method and apparatus for detecting the end of life of a print cartridge for a thermal ink jet printer determines the status of the print cartridge and warns the user if the print cartridge is at or near the end of its useful life. In a first mode of operation, an initial temperature of a printhead contained in the print cartridge is checked after a threshold amount of ink is expelled from the printhead, such as for a high density print swath or during a service routine. This initial temperature is then compared with a maximum initial temperature. If the initial temperature exceeds the maximum initial temperature, a warning about the status of the print cartridge is sent to a user. If the initial temperature does not exceed the maximum initial temperature, the user is informed of the remaining life portion of the print cartridge. In a second mode of operation, a final temperature is checked after a period of time elapses since the threshold amount of ink is expelled from the printhead. This final temperature is then compared to a maximum final temperature. If the final temperature exceeds the maximum final temperature, a warning about the status of the print cartridge is sent to a user. If the final temperature is less than the maximum final temperature, the user is informed of the remaining life portion of the print cartridge. In a third mode of operation, the heat transfer efficiency of the print cartridge is calculated. If the heat transfer efficiency of the print cartridge is below a minimum heat transfer efficiency, a warning about the status of the print cartridge is sent to a user. If the heat transfer efficiency exceeds a minimum heat transfer efficiency, the user is informed of the remaining life portion of the print cartridge.

21 Claims, 6 Drawing Sheets

U.S. PATENT DOCUMENTS 5,682,140 * 10/1997 Christensen et al. ..... 347/7
5,682,183 * 10/1997 Wade et al. ..... 347/7
5,699,090 12/1997 Wade et al. ..... 347/7
5,721,573 * 2/1998 Benjamin ..... 347/7
5,757,390 * 5/1998 Gragg et al. ..... 347/7
5,886,713 3/1999 Okada et al. ..... 347/14

* cited by examiner

METHOD AND APPARATUS FOR DETECTING THE END OF LIFE OF A PRINT CARTRIDGE FOR A THERMAL INK JET PRINTER

FIELD OF THE INVENTION

This invention relates to the printer field. More particularly, this invention is a method and apparatus for detecting the end of life of a print cartridge for a thermal ink jet printer.

BACKGROUND OF THE INVENTION

Thermal ink jet printers have experienced great commercial success since they were invented back in the early 1980's. Modern day thermal ink jet printers give users high speed printing capabilities along with near photographic quality color reproduction, all for a very low price. These attributes have made a high quality thermal ink jet printer an essential part of a home or office computing system.

In recent times, users have found that the thermal ink jet printer can be used not only to print text and numbers from word processing programs and spreadsheets, but can also be used to print images they have downloaded from the Internet, or even print their own photographs from pictures they have taken with their digital camera. In addition, users are now able to print off their own personalized catalogs, annual reports, newspapers and magazines-all using their ink jet printer in the comfort and convenience of their home or office.

This increase in the amount of material printed by a printer has resulted in a trend in the printer industry towards replenishable printing systems. One example of a replenishable printing system is an "off axis" printing system, where the supply of ink in the print cartridge is replenished via another ink supply, typically located remotely to the print cartridge but connected via tubing or the like. Such replenishable printing systems allow the print cartridge to be used for a longer period of time than what has been conventionally done in the past, where the print cartridge was typically thrown away after the ink supply was exhausted.

While such replenishable printing systems can result in a lower total printing cost to the user, such systems have raised new problems that, left unaddressed, may actually result in a great deal of inconvenience and additional expense to the user. One such problem is that the print cartridge of the ink jet printer can reach the end of its useful life and fail to print properly during a critical printing operation. While this failure may be proceeded by a diminished print quality, this may not be noticed by the user at all, or at least not until the print cartridge fails to print reliably and it is too late to go out and purchase a replacement print cartridge. Of course, these failures often seem to occur at the worst possible moment, usually the day a big deadline looms or a big presentation is due.

While some attempts have been made to notify a user that the replenishable ink supply is running out of ink, these attempts do not solve the problem caused by a print cartridge failure independent of the amount of available ink, since a printer with a print cartridge at the end of its useful life will not print properly, or at all, even if there is an adequate supply of ink.

SUMMARY OF THE INVENTION

A method and apparatus for detecting the end of life of a print cartridge for a thermal ink jet printer determines the status of the print cartridge and warns the user if the print cartridge is at or near the end of its useful life. In a first mode of operation, an initial temperature of a printhead contained in the print cartridge is checked after a threshold amount of ink is expelled from the printhead, such as for a high density print swath or during a service routine. This initial temperature is then compared with a maximum initial temperature. If the initial temperature exceeds the maximum initial temperature, a warning about the status of the print cartridge is sent to a user. If the initial temperature does not exceed the maximum initial temperature, the user is informed of the remaining life portion of the print cartridge. In a second mode of operation, a final temperature is checked after a period of time elapses since the threshold amount of ink is expelled from the printhead. This final temperature is then compared to a maximum final temperature. If the final temperature exceeds the maximum final temperature, a warning about the status of the print cartridge is sent to a user. If the final temperature is less than the maximum final temperature, the user is informed of the remaining life portion of the print cartridge. In a third mode of operation, the heat transfer efficiency of the print cartridge is calculated. If the heat transfer efficiency of the print cartridge is below a minimum heat transfer efficiency, a warning about the status of the print cartridge is sent to a user. If the heat transfer efficiency exceeds a minimum heat transfer efficiency, the user is informed of the remaining life portion of the print cartridge.

DETAILED DESCRIPTION OF THE PREFERRED AND ALTERNATE EMBODIMENTS

Figure 1:
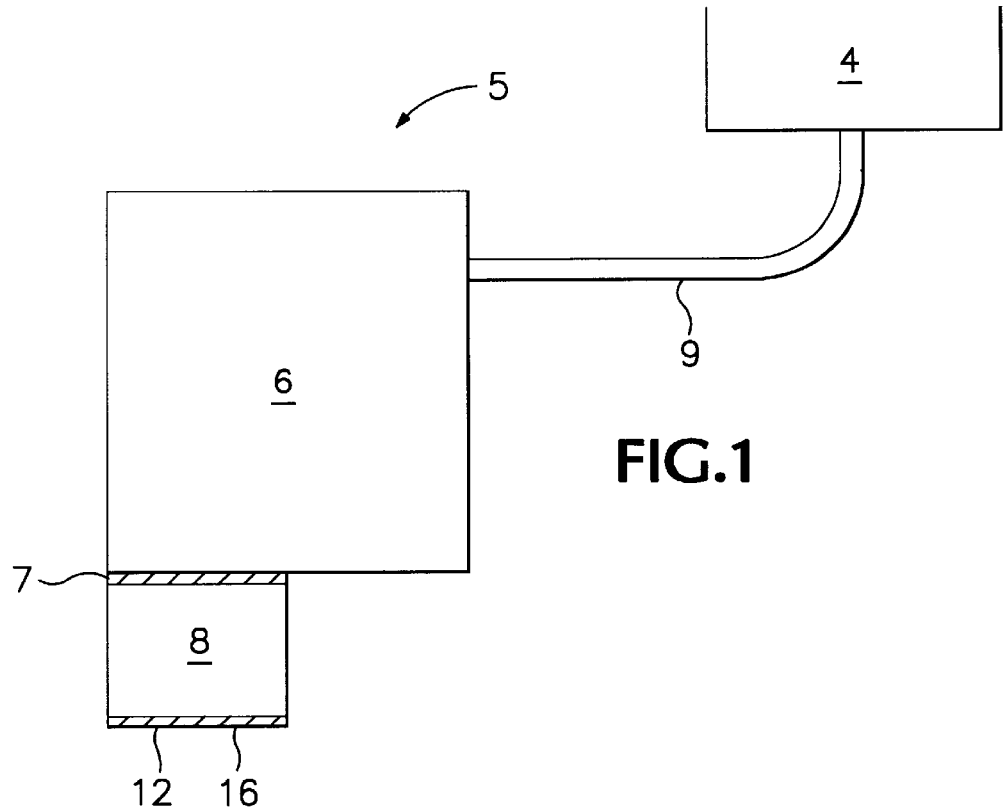
FIG. 1 shows a cross section of a print cartridge for a thermal ink jet printer used in the preferred embodiment of the invention.

FIG. 1 shows a cross section of an print cartridge for a thermal ink jet printer used in the preferred embodiment of the invention. Print cartridge 5 contains ink reservoir 6. In the preferred embodiment, ink reservoir 6 is connected to hose 9 to be refilled automatically via "off axis" ink source 4. An alternate embodiment has been contemplated where hose 9 is not present and ink reservoir 6 is refilled manually via an aperture (not shown) in ink reservoir 6.

During a printing operation, ink flows out of ink reservoir 6 towards printhead 12. Filter 7 screens out impurities and large air bubbles that may be present in the ink, thereby preventing these impurities and large air bubbles from reaching printhead 12. The filtered ink then passes through standpipe 8 to printhead 12. Printhead 12 contains hundreds of tiny resistors that selectively heat up the filtered ink and expel it through a corresponding number of tiny nozzles onto a media, such as paper or transparencies.

As the filtered ink is heated by the resistors, any air that may still be present in the ink can separate out from the ink, and can become trapped in standpipe 8. While very little air separates out from the ink in any single printing operation, this trapped air can accumulate over time until a substantial amount of air is trapped in standpipe 8. When a substantial amount of air is trapped in standpipe 8, the trapped air prevents ink flow from reservoir 6 to printhead 12. This phenomenon, referred to herein as "die outgassing", in effect "starves" the printhead by not allowing ink to reach it. If ink cannot reach printhead 12, the printer cannot print. In addition, die outgassing can cause printhead 12 to overheat, since a liquid (i.e., ink) is much more efficient at dissipating heat from printhead 12 than a gas (i.e., an air bubble), as will be discussed in more detail later. If printhead 12 overheats too much, some or all of the hundreds of tiny resistors in printhead 12 can burn out and fail to function. In either event, print cartridge 5 has reached the end of its life and needs to be replaced.

Printhead 12 also contains temperature sensor 16, the operation of which will be discussed in more detail later.

Figure 2:
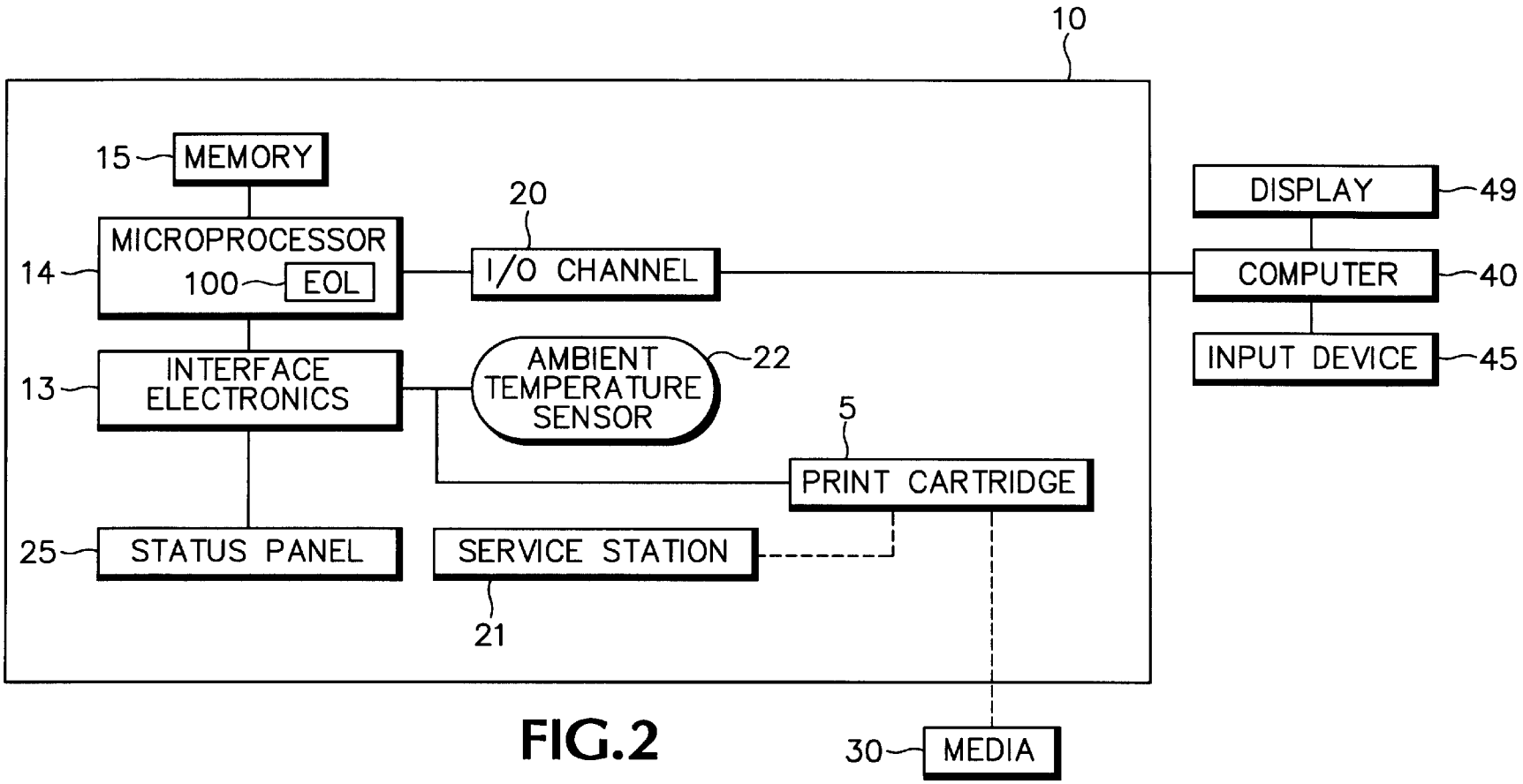
FIG. 2 shows a block diagram of a ink jet printing system of the preferred embodiment of the invention.

FIG. 2 shows a block diagram of a ink jet printing system of the preferred embodiment of the invention. Ink jet printer 10 contains microprocessor 14 connected to memory 15, interface electronics 13 and I/O channel 20. Microprocessor 14 is suitably programmed to carry out the operations of printer 10. Microprocessor 14 contains print cartridge end of life detector 100, the operation of which will be discussed in more detail later.

Microprocessor 14 is operatively coupled to print cartridge 5 (FIG. 1) and status panel 25 via interface electronics 13. Status panel 25 is preferably one or more lights on the case of printer 10 that provides status information to the user, although an alternate embodiment has been contemplated where status panel 25 is a display or other form of enunciator of status to the user.

Microprocessor 14 receives instructions and data from computer 40 via I/O channel 20. Computer 40 is connected to display 49 and input device 45. A printing operation is commenced when a user instructs computer 40 via input device 45 to print a desired document, image, or the like. Computer 40 sends a print command to printer 10. This command is received by I/O channel 20 and sent on to microprocessor 14. Microprocessor 14 interprets the command and selectively fires the resistors contained in printhead 12 of print cartridge 5, thereby expelling ink onto media 30 in a pattern/color corresponding to the desired document or image.

In the preferred embodiment, end of life detector 100 contained in microprocessor 14 monitors the temperature of printhead 12 during the printing and servicing operation via temperature sensor 16 contained in printhead 12 (FIG. 1). In the preferred embodiment, temperature sensor 16 contains a thermal sense resistor and associated memory. During the manufacturing process of print cartridge 5, the value of the thermal sense resistor is measured at a known, controlled ambient temperature. This measured value, along with the thermal coefficient of resistivity of the thermal sense resistor, is then used to calculate the value of this resistance at a typical operating temperature, such as 45° C., although the value at another preselected temperature could be the stored value and still fall within the spirit and scope of the invention. The operating resistance value is then stored in the associated memory of temperature sensor 16. For even greater accuracy, a "rolling average" thermal coefficient of resistivity value, representing the average thermal coefficient of resistivity values from the thermal sense resistors from the most recently manufactured batch of print cartridge units, is factored into the calculation discussed above. This serves a damping function to reduce the potentially negative effects of any one particular thermal sense resistor that has a value much higher or much lower than average. As will be discussed in more detail later, end of life detector 100 can accurately calculate the temperature of printhead 12 by measuring the value of the resistance of the thermal sense resistor in temperature sensor 16, and comparing this value with the resistance value stored in the associated memory of temperature sensor 16.

Figure 3A:
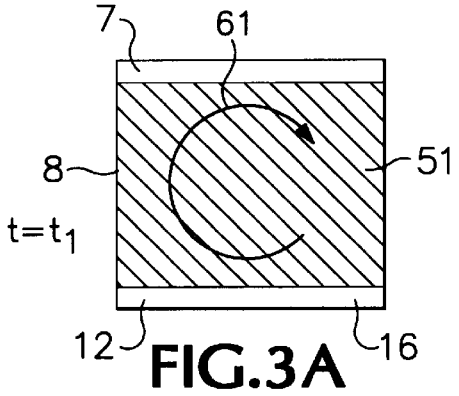
FIGS. 3A–3D show a cross section of the standpipe portion of the print cartridge for a thermal ink jet printer during different exemplary stages of the operating life of the print cartridge.

FIGS. 3A–3D show a cross section of standpipe 8 of the print cartridge 5 during different exemplary stages of the operating life of print cartridge 5. FIG. 3A shows standpipe 8 at a point of time at the beginning of the life of print cartridge 5, referred to herein as $t=t_1$. Standpipe 8 is shown filled with ink 51 between filter 7 and printhead 12. Convection current 61 is established that allows heat from printhead 12 to circulate through ink 51, thereby cooling printhead 12.

Figure 3B:
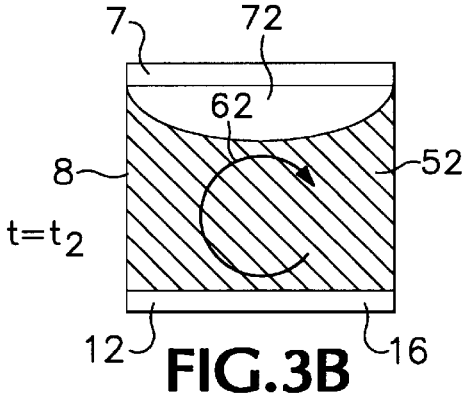

FIG. 3B shows standpipe 8 at a point of time at the middle of the life of print cartridge 5, referred to herein as $t=t_2$. Note that air bubble 72 has formed on the surface of filter 7. Standpipe 8 is shown filled with ink 52 between bubble 72 and printhead 12. Convection current 62 is established that allows heat from printhead 12 to circulate through ink 52, thereby cooling printhead 12. Since there is less ink in standpipe 8 in FIG. 3B due to the existence of air bubble 72, convection current 62 is not as efficient at cooling printhead 12 as was convection current 61 of FIG. 3A.

Figure 3C:
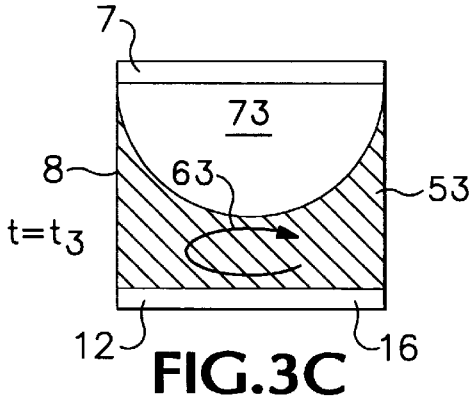

FIG. 3C shows standpipe 8 at a point of time near the end of the life of print cartridge 5, referred to herein as $t=t_3$. Note that air bubble 73 has gotten quite large and now takes up a significant portion of the volume of standpipe 8. Ink 53 makes up the remainder of the portion of the volume of standpipe 8. Convection current 63 is established that allows heat from printhead 12 to circulate through ink 53, thereby cooling printhead 12. Since there is still less ink in standpipe 8 in FIG. 3C due to the existence of air bubble 73, convection current 63 is not as efficient at cooling printhead 12 as was convection current 62 of FIG. 3B or convection current 61 of FIG. 3A.

Figure 3D:
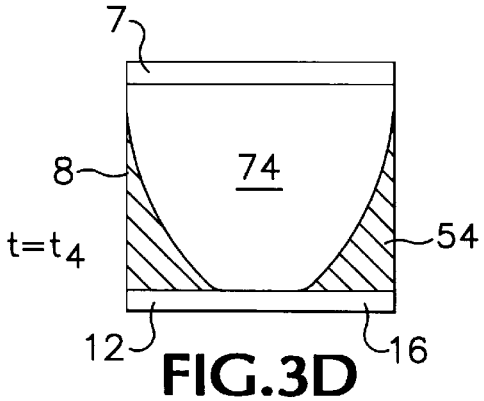

FIG. 3D shows standpipe 8 at a point of time at the end of the life of print cartridge 5, referred to herein as $t=t_4$. Note that air bubble 74 reaches all the way to printhead 12 and now takes up most of the volume of standpipe 8. At this point, die outgassing has occurred. Air bubble 74 prevents the ink from flowing from reservoir 6 (FIG. 1) through filter 7 to printhead 12. Print quality is very poor at this point of time, and remaining ink 54 will soon be expelled through printhead 12. No convection current is established in remaining ink 54, so printhead 12 is not cooled effectively. The temperature of printhead 12 at $t=t_4$ is considerably hotter than it was at $t=t_1$, $t=t_2$, or $t=t_3$. Some or all of the resistors in printhead 12 will now overheat and fail.

Figure 4:
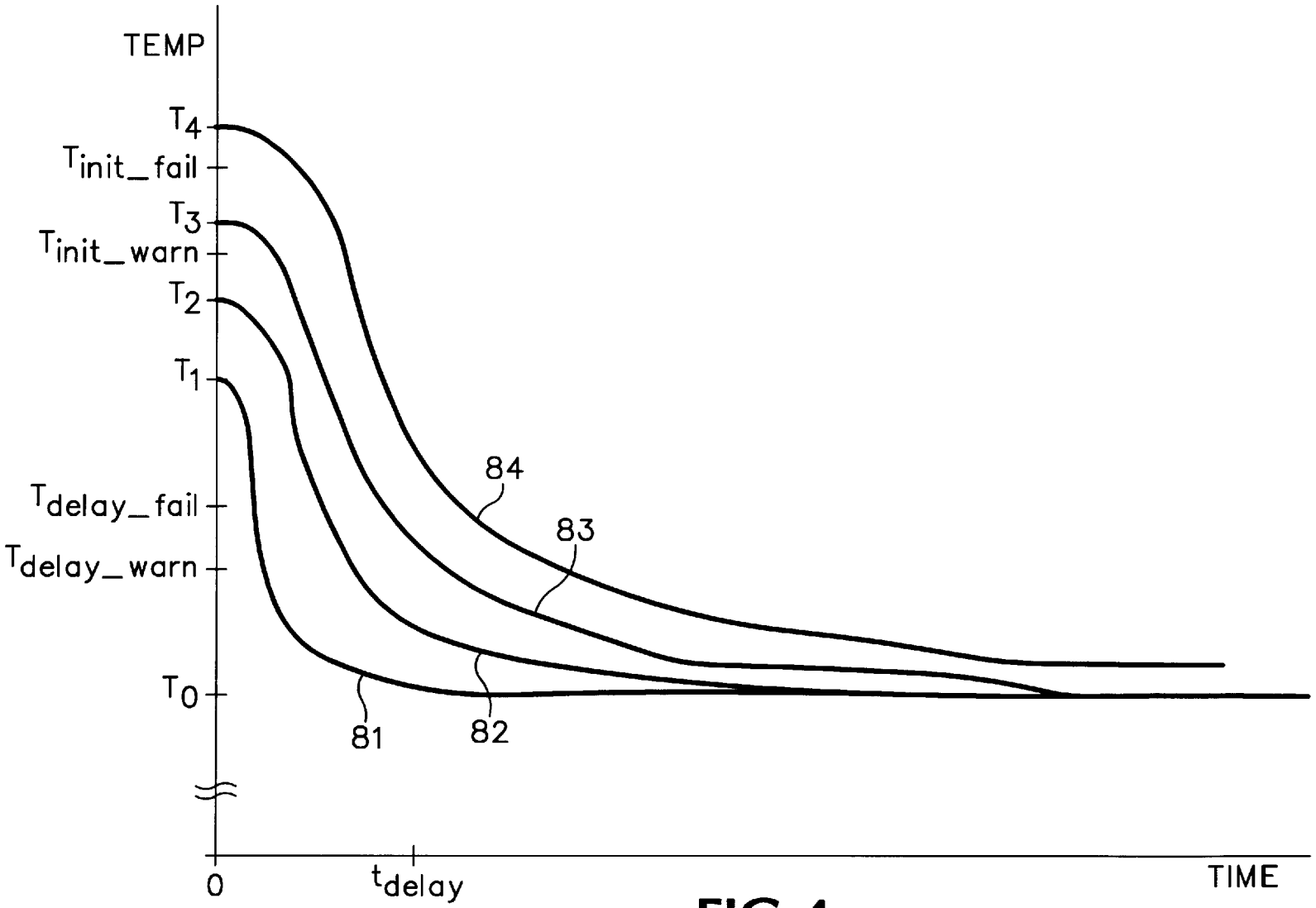
FIG. 4 shows a graph of temperature versus time for a printhead during different exemplary stages of the operating life of the print cartridge.

FIG. 4 shows a graph of printhead temperature versus time for printhead 12 during different exemplary stages of the operating life of print cartridge 5, as calculated by end of life detector 100 via information it receives from temperature sensor 16, as discussed above. Graph 81 shows printhead 12 when print cartridge 5 is at the beginning of its operating life: $t=t_1$. Graph 81 corresponds to FIG. 3A. Graph 82 shows printhead 12 when print cartridge 5 is at the middle of its operating life: $t=t_2$. Graph 82 corresponds to FIG. 3B. Graph 83 shows printhead 12 when print cartridge 5 is near the end of its operating life: $t=t_3$. Graph 83 corresponds to FIG. 3C. Graph 84 shows printhead 12 when print cartridge 5 is at the end of its operating life: $t=t_4$. Graph 84 corresponds to FIG. 3D.

At t=0, printer 10 has received a command to print, where a threshold amount of ink is expelled just prior to time t=0. The temperature of printhead 12 is highest immediately after the threshold amount of ink is expelled through the printhead, then decreases over time.

Note that beginning of life curve 81 (corresponding to $t=t_1$ and FIG. 3A) reaches an initial temperature of $T_1$, and quickly falls almost to $T_0$ at time=$t_{delay}$. This is considered normal and is indicative of a healthy print cartridge at or near the beginning of its life.

Middle of life curve 82 (corresponding to $t=t_2$ and FIG. 3B) reaches an initial temperature of $T_2$ and falls more slowly to a temperature higher than $T_0$ at time=$t_{delay}$. Note that $T_2$ is higher than $T_1$, due to the less efficient cooling ability of convection current 62 (FIG. 3B). This is considered normal and is indicative of a healthy print cartridge at the middle of its life. The user may be informed that his/her print cartridge has a portion (e.g., 50%) of its useful life remaining.

Near end of life curve 83 (corresponding to $t=t_3$ and FIG. 3C) reaches an initial temperature of $T_3$ and falls still more slowly to a temperature higher than $T_{delay_warn}$ at time=$t_{delay}$. Note that $T_3$ is higher than both $T_2$ and $T_1$, due to the still less efficient cooling ability of convection current 63 (FIG. 3C). Note also that $T_3$ is higher than $T_{init_warn}$. Curve 83 is indicative of a print cartridge near the end of its life. The user should be warned, either now or soon, that s/he should replace the print cartridge with a new one.

At end of life curve 84 (corresponding to $t=t_4$ and FIG. 3D) reaches an initial temperature of $T_4$ and falls ever so slowly to a temperature higher than $T_{delay_fail}$ at time=$t_{delay}$. Note that $T_4$ is higher than $T_3$, $T_2$ and $T_1$, due to the lack of a convection current (FIG. 3D). Note also that $T_4$ is higher than $T_{init_fail}$. Curve 84 is considered indicative of a print cartridge at the end of its life, where die outgassing, causing ink starvation and/or resistor failure, has already occurred or will occur imminently. The user should be warned immediately that his/her print cartridge has failed (or will imminently fail) and should be replaced.

Figure 5:
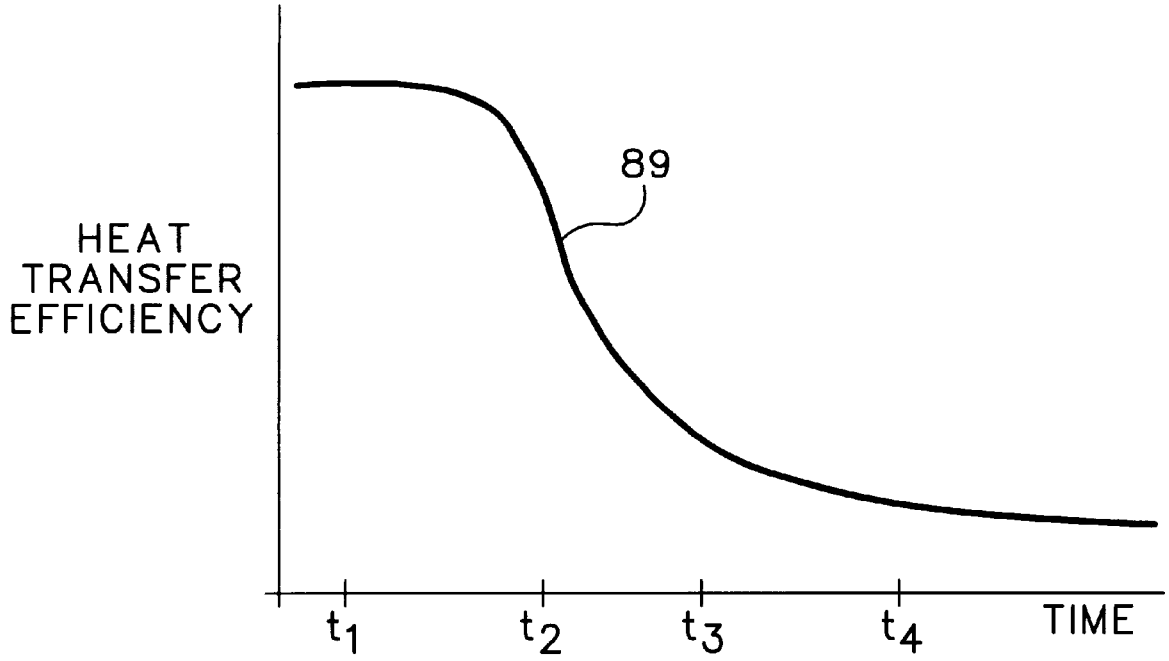
FIG. 5 shows a graph of heat transfer efficiency versus time for the life of a printhead.

FIG. 5 shows graph of heat transfer efficiency versus time for the life of a printhead. Note that in curve 89 the heat transfer efficiency of the printhead starts out high at $t=t_1$ (corresponding to FIG. 3A and curve 81 of FIG. 4), begins to fall at $t=t_2$ (corresponding to FIG. 3B and curve 82 of FIG. 4), falls more rapidly at $t=t_3$ (corresponding to FIG. 3C and curve 83 of FIG. 4), then bottoms out at $t=t_4$ (corresponding to FIG. 3D and curve 84 of FIG. 4). Those skilled in the art will appreciate that curve 89 may take on different characteristics in different printhead architectures and standpipe geometries.

Figure 6:
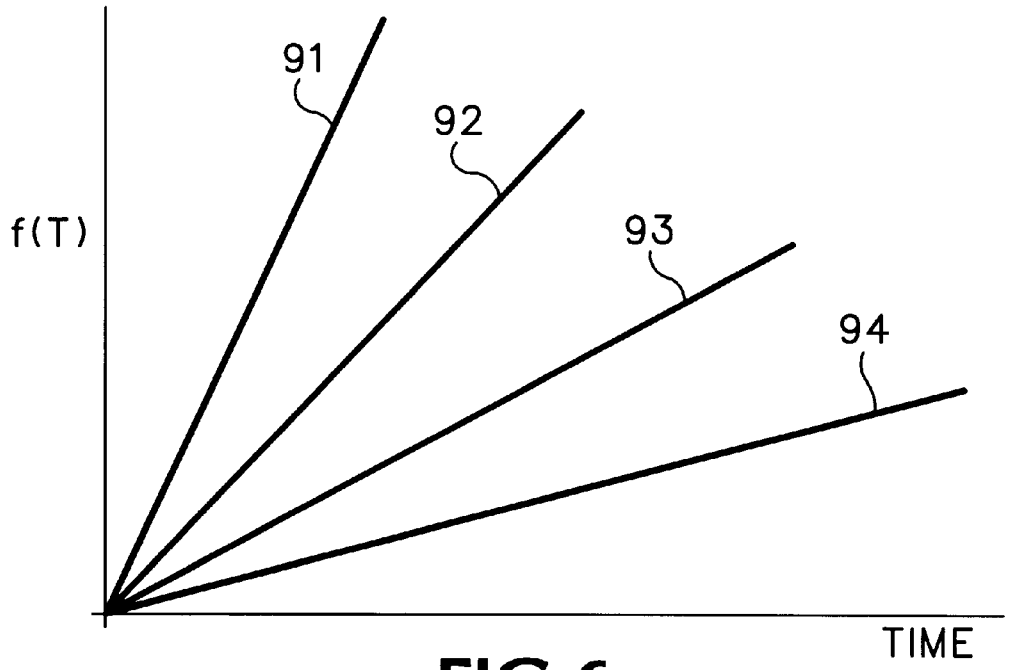
FIG. 6 shows a graph of a linearized function of temperature versus time for the life of a printhead.

FIG. 6 shows a graph of a linearized function of temperature versus time for the life of a printhead. The graph of FIG. 6 is a linearized version of the graph of FIG. 4. The slopes of the lines in FIG. 6 are directly related to heat transfer efficiencies. Heat transfer efficiency line 91 corresponds to a heat transfer efficiency at $t=t_1$ (which in turn corresponds to FIG. 3A and curve 81 of FIG. 4). Heat transfer efficiency line 92 corresponds to a heat transfer efficiency at $t=t_2$ (which in turn corresponds to FIG. 3B and curve 82 of FIG. 4). Heat transfer efficiency line 93 corresponds to a heat transfer efficiency at $t=t_3$ (which in turn corresponds to FIG. 3C and curve 83 of FIG. 4). Heat transfer efficiency line 94 corresponds to a heat transfer efficiency at $t=t_4$ (which in turn corresponds to FIG. 3D and curve 84 of FIG. 4). Note that the slope of the curves in FIG. 6 gets smaller as the heat transfer efficiency of the printhead declines. The significance of this fact will be discussed shortly.

Figure 7:
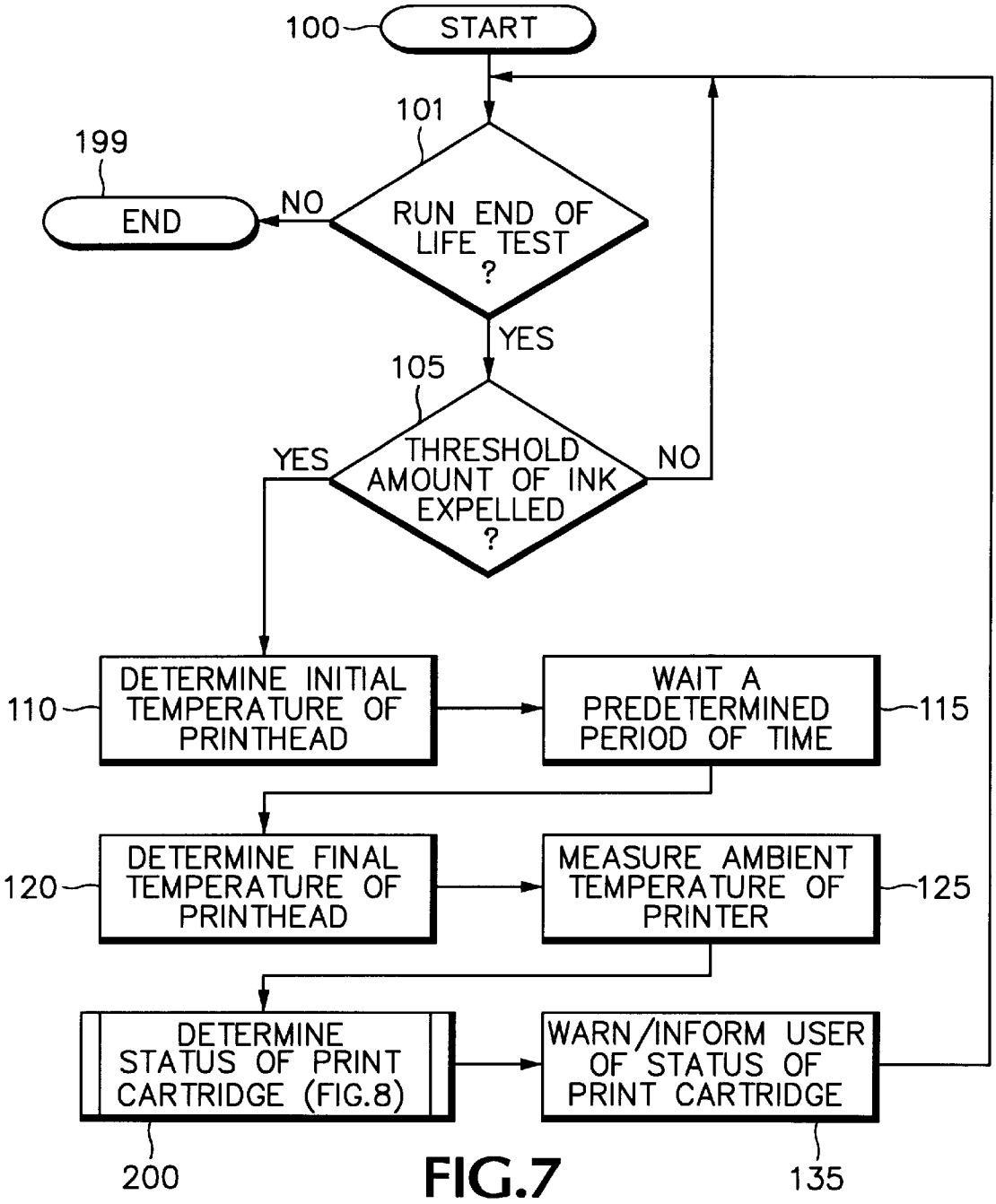
FIGS. 7–8 shows a flowchart of the operation of the end of life detector of the preferred embodiment of the invention.
Figure 8:
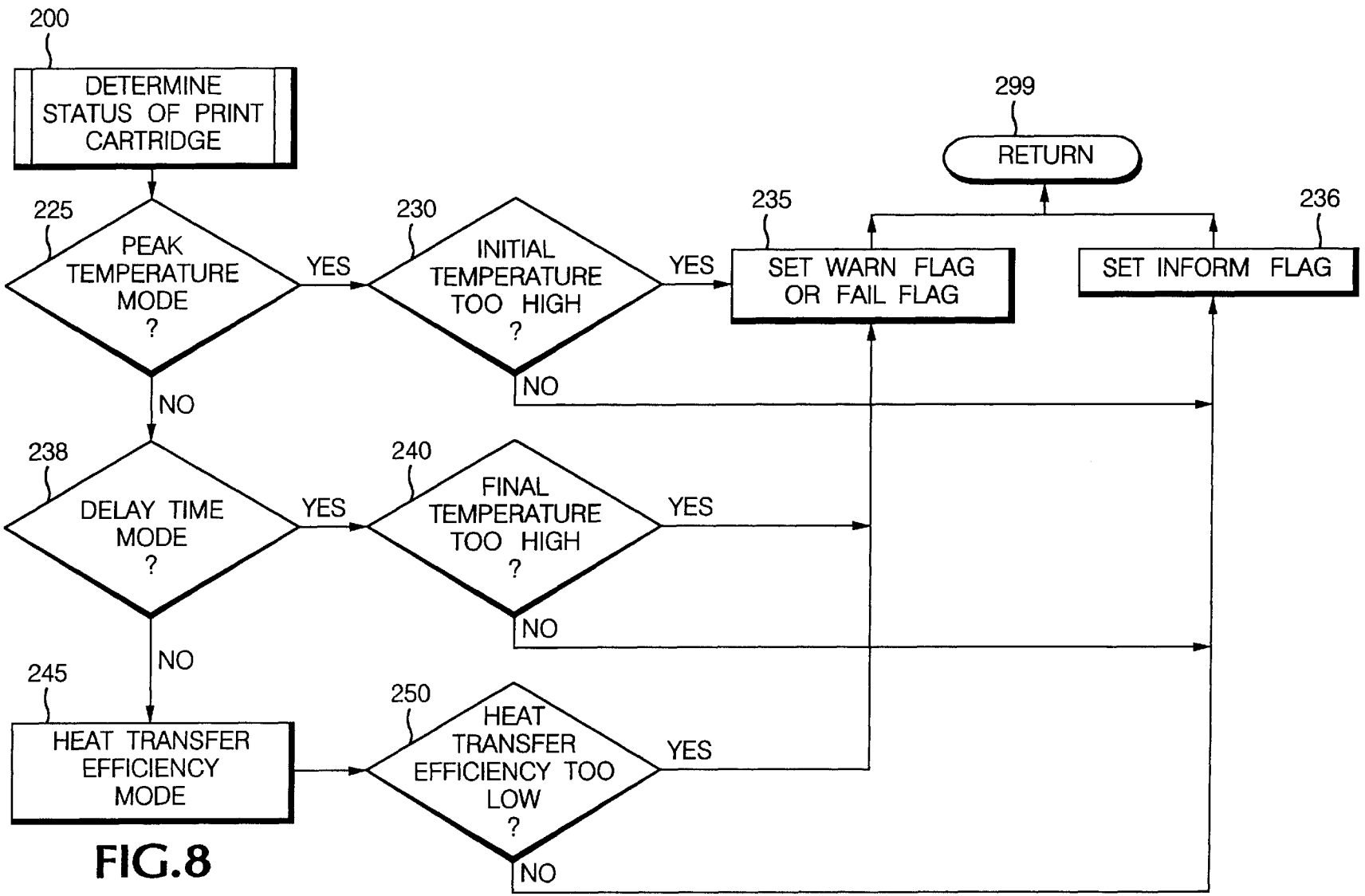

FIGS. 7–8 show a flowchart of the operation of end of life detector 100 of the preferred embodiment of the invention. In the preferred embodiment, end of life detector 100 is software stored in memory 15 and executed in processor 14, although an alternate embodiment has been contemplated where end of life detector 100 is a comparable special purpose hardware circuit that performs the same functions shown in FIGS. 7–8. Referring now to FIG. 7, block 101 checks to see if an end of life test for print cartridge 5 should be run. In the preferred embodiment, this test is only run during another service event, such as a wet wipe, scrub, or prime operation. Printer 10 routinely performs such types of service on print cartridge 5 to keep it operating at peak performance. During a service event, print cartridge 5 is typically parked in service station 21 (FIG. 2).

An alternate embodiment has been contemplated where the end of life test is run more frequently during normal printing operations. This test could be run continuously as printer 10 is printing, or could be run less frequently, such as after a certain number of ink drops have been fired or after a certain period of time has elapsed. In any event, if block 101 is answered negatively, the flowchart terminates in block 199.

If the end of life test is to be run, block 105 checks to see if a threshold amount of ink has been expelled from printhead 12. In the preferred embodiment, while print cartridge 5 is parked in service station 21, a command to expel a threshold amount of ink (the equivalent of a high density print swath) into a "spittoon" or "diaper" in service station 21 is executed. This command causes the resistors in printhead 12 to heat up and expel an amount of ink. In an alternate embodiment, the end of life test is run upon the occurrence of the printing of a high density print swath (equivalent to a threshold amount of ink being expelled) on media 30 (FIG. 2) during a normal printing operation. In this embodiment, low density print swaths are ignored, since it is more difficult to accurately run the end of life test with low density print swaths, although other embodiments have been contemplated where the threshold amount of ink is any amount of ink.

If block 105 detects that a threshold amount of ink has been expelled (either during a service event or during normal printing operation, depending on the embodiment), block 110 determines the temperature of printhead 12 at the completion of the expulsion of the threshold amount of ink (referred to herein as the "initial temperature", or t=0). This temperature is determined by measuring the resistance of the thermal sense resistor of temperature sensor 16 and comparing this resistance with the resistance value stored in the associated memory of temperature sensor 16. As has been discussed, the resistance value stored in the associated memory of temperature sensor 16 is the value of the thermal sense resistor at a typical operating temperature, such as 45° C. By comparing these two resistance values and knowing the typical thermal coefficient of resistivity specified in the manufacturing process, the temperature of printhead 12 can be accurately determined.

After block 110 determines the initial temperature of printhead 12, block 115 waits a predetermined period of time. After this predetermined period of time has elapsed, block 120 determines the temperature of printhead 12, referred to herein as the "final temperature". The final temperature is determined in the same manner as the "initial temperature" was determined, as discussed above.

Block 125 then measures the ambient temperature of the printer. In the preferred embodiment, this is determined by reading the value of ambient temperature sensor 22 contained inside printer 10 (FIG. 2). Typically, this ambient temperature will be at or slightly above the normal environmental temperature of the room or building printer 10 resides in. This printer ambient temperature is used in one of the modes of operation used to determine the status of the printer, as will be discussed.

Block 200 calls the Determine Status of Print Cartridge subroutine of FIG. 8. Referring now to FIG. 8, subroutine 200 preferably operates in a choice of three different modes of operation: Peak Temperature Mode, Delay Time Mode, and Heat Transfer Mode. While in the preferred embodiment the Heat Transfer Mode is selected, alternate embodiments have been contemplated where one of the other modes is selected instead. In addition, additional alternate embodiments have been contemplated where a combination of modes is selected. In these additional alternate embodiments, a "voting" procedure may be used, where a unanimous or majority vote of the different modes determines the status of the print cartridge.

If Peak Temperature Mode is selected (either by a user, preselected at the factory, the only mode available, etc.), block 225 is answered affirmatively, and flow of control moves to block 230. Block 230 checks to see if the initial temperature is too high. In the preferred embodiment, this is done by comparing the initial temperature with a maximum initial temperature stored in memory 15 (FIG. 2). In the preferred embodiment, the maximum initial temperature is the highest temperature a printhead of a properly functioning print cartridge should reach after it prints a high density print swath. In our example shown in FIG. 4, this maximum temperature would be $Temp_{init_warn}$ shown as being between $T_2$ and $T_3$.

If block 230 determines that the initial temperature is too high, block 235 sets a warning flag, indicating that the print cartridge has less than a specified percentage of its life left. If Block 230 determined that the initial temperature exceeds $T_{init_fail}$ (FIG. 4), the print cartridge has reached the end of its life and a fail flag is set in block 235. Flow of control moves to block 299, where the subroutine returns to block 135 (FIG. 7), which warns the user that the print cartridge is either near the end of its useful life and should be replaced soon (if $T_{init_warn}<T<T_{init_fail}$), or has reached the end of its useful life and must be replaced immediately (if $T>T_{init_fail}$). Preferably, printer 10 sends a command to computer 40 via I/O channel 20 to display this message on display 49, but alternate embodiments have been contemplated where this message is printed out on media 30 and/or displayed on status panel 25. In any event, after the user is properly warned, flow of control returns back to block 101.

An alternate embodiment has been contemplated where the warning message is not given immediately after the warning flag is set in block 235, but after a predetermined number of pages have been printed (or drops of ink expelled) after the warning flag is set. This embodiment may give more accurate results in some situations.

Note that the warning message given does not tell the user that their print cartridge is low on or out of ink, but that their print cartridge is near or has reached the end of its useful life. In the preferred embodiment, there is a separate detection mechanism contained in or associated with ink source 4 that provides an additional warning to the user that he/she is almost out of ink. This mechanism typically measures the ink level of ink source 4 (FIG. 1). This can be done in much the same manner as the gasoline level in a gas tank of an automobile is measured, or by more complex measurement techniques, such as optical detection, monitoring the mechanism response (resistance, rebound, etc.) of the pump (not shown) between ink source 4 and ink reservoir, etc. As has been discussed previously, an end of life warning can be given even if ink source 4 is full of ink, due to die outgassing. Those skilled in the art will also appreciate that if a user ignores the warnings that ink source 4 is low on ink and allows ink source 4 to run dry of ink, the lack of ink in standpipe 8 will cause the temperature of printhead 12 to rise and trigger an end of life warning, as the air in standpipe 8 will permanently starve printhead 12 of ink—even if ink source 4 is later refilled.

An alternate embodiment has been contemplated where the warning message discussed above is not sent to the user unless end of life detector 100 also determines that a predetermined number of drops of ink have been fired from printhead 12, or a predetermined amount of total printing time has elapsed, thereby providing an independent, corroborating basis for concluding that print cartridge 5 is indeed reaching the end of its life. While this embodiment adds complexity to end of life detector 100 and may result in an increased number of false negatives (i.e., print cartridge deemed acceptable when it really isn't), it may tend to reduce the number of false positives (i.e., print cartridge deemed at end of life when it really isn't) and may be desirable in some applications.

Referring again to FIG. 8, if block 230 determines that the initial temperature is within acceptable limits, block 236 sets an "inform flag" containing the portion of the useful life of the print cartridge estimated as being remaining. The subroutine then returns to block 135 of FIG. 7, where the user is informed of the percentage of life left in the print cartridge. In the preferred embodiment, this informational message is not given to the user unless the user has specifically requested to know such status about the ink supply unit, or if this status is unobtrusively displayed on display 49 or status panel 25. In any event, flow of control returns back to block 101.

If the Peak Temperature Mode is not selected, block 225 (FIG. 8) is answered negatively, and block 238 checks to see if Delay Time Mode is selected. If Delay Time Mode is selected (either by a user, preselected at the factory, the only mode available, etc.), block 238 is answered affirmatively, and flow of control moves to block 240. Block 240 checks to see if the final temperature is too high. If the final temperature is too high, this would indicate that the printhead took longer to cool down to a normal operating temperature than it should have, probably as the result of die outgassing. In the preferred embodiment, the final temperature, measured as discussed above, is compared to a maximum final temperature. This maximum final temperature is the highest temperature the printhead should be after a predetermined period of time has elapsed since the threshold amount of ink was expelled from printhead 12. In our example shown in FIG. 4, this maximum temperature is $T_{delay_warn}$, shown as being between the temperatures of curve 82 and curve 83 at time=$t_{delay}$.

If block 240 determines that the final temperature is too high (i.e., $T_{delayt_warm}<T<T_{delay_fail}$), block 235 sets a warning flag, indicating that the print cartridge has less than a specified percentage of its life left. If Block 240 determined that the initial temperature exceeds $T_{delay_fail}$ (FIG. 4), the print cartridge has reached the end of its life and a fail flag is set in block 235. Flow of control moves to block 299, where the subroutine returns to block 135 (FIG. 7), which warns the user that the print cartridge is either near the end of its useful life and should be replaced soon (if $T_{delay_warn}<T<T_{delay_fail}$), or has reached the end of its useful life and must be replaced immediately (if $T>T_{delay_fail}$), in the manner discussed in more detail above. After the user is properly warned, flow of control returns back to block 101.

A second embodiment of the Delay Time Mode has been contemplated where the period of time it takes the printhead to cool to a given temperature, such as $T_0$, is measured in block 240. If this final time is too high, this would indicate that the printhead took longer to cool down to a normal operating temperature than it should have, probably as the result of die outgassing. As with the first embodiment of the Delay Time Mode described above, the final time to reach a predetermined temperature can be used to warn the user that the print cartridge has less than a specified percentage of its life left or that the print cartridge has reached the end of its life.

If block 240 determines that the final temperature (or final time) is within acceptable limits, block 236 sets an "inform flag" containing the portion of the useful life of the print cartridge estimated as being remaining. The subroutine then returns to block 135 of FIG. 7, where the user is informed of the percentage of life left in the print cartridge. As discussed above, this informational message is not given to the user unless the user has specifically requested to know such status about the ink supply unit, or if this status is unobtrusively displayed on display 49 or status panel 25. In any event, flow of control returns back to block 101.

If the Delay Time Mode is not selected, block 245 (FIG. 8) selects Heat Transfer Efficiency Mode, and flow of control moves to block 250. Block 250 checks to see if the heat transfer efficiency is too low. In the preferred embodiment, this is determined by looking at a linearized graph of temperature versus time such as that shown in FIG. 6. If the slope of the heat transfer efficiency line is less than a warning slope, such as a slope between the slopes of heat transfer efficiency lines 92 and 93 of FIG. 6, the heat transfer efficiency of the printhead is too low. If block 250 determines that the heat transfer efficiency of the printhead is too low, block 235 sets a warning flag, indicating that the print cartridge has less than a specified percentage of its life left. If Block 250 determined that the slope of the heat transfer efficiency line is less than a failure slope, such as a slope between heat transfer efficiency lines 93 and 94 of FIG. 6, the print cartridge has reached the end of its life and a fail flag is set in block 235. Flow of control moves to block 299, where the subroutine returns to block 135 (FIG. 7), which warns the user that the print cartridge is either near the end of its useful life and should be replaced soon (if Warning Slope>Slope>Failure Slope), or has reached the end of its useful life and must be replaced immediately (if Slope>Failure Slope), in the manner discussed in more detail above. After the user is properly warned, flow of control returns back to block 101.

If block 250 determines that the heat transfer efficiency is within acceptable limits, block 236 sets an "inform flag" containing the portion of the useful life of the print cartridge estimated as being remaining. The subroutine then returns to block 135 of FIG. 7, where the user is informed of the percentage of life left in the print cartridge. As discussed above, this informational message is not given to the user unless the user has specifically requested to know such status about the ink supply unit, or if this status is unobtrusively displayed on display 49 or status panel 25. In any event, flow of control returns back to block 101.

Referring back to FIGS. 3–6 in conjunction with the above discussion of FIG. 7–8, the flowchart of FIGS. 7–8 would determine that the printhead at or near the beginning of its useful life (FIG. 3A, curve 81 of FIG. 4, $t=t_1$ of FIG. 5, and heat transfer efficiency line 91 of FIG. 6) was operating acceptably, and the user would be informed as to the estimated percentage of useful life remaining. The printhead at the middle of its useful life (FIG. 3B, curve 82 of FIG. 4, $t=t_2$ of FIG. 5, and heat transfer efficiency line 92 of FIG. 6) was also operating acceptably, and the user would be informed as to the estimated (albeit lower) percentage of useful life remaining. The printhead near the end of its useful life (FIG. 3C, curve 83 of FIG. 4, $t=t_3$ of FIG. 5, and heat transfer efficiency line 93 of FIG. 6) would result in a warning to the user that the printhead was near the end of its useful life and should be replaced soon. The printhead at the end of its useful life (FIG. 3D, curve 84 of FIG. 4, $t=t_4$ of FIG. 5, and heat transfer efficiency line 94 of FIG. 6) would result in a warning to the user that the printhead was at the end of its useful life and should be replaced immediately.

What is claimed is:

1. A method of detecting an end of useful life of a print cartridge having a printhead, the print cartridge used in a replenishable printing system, the useful life being independent of the amount of available ink in the printing system for the printhead, the method comprising the steps of:

with the print cartridge installed in the replenishable printing system wherein a supply of ink in the print cartridge is replenished via another ink supply, expelling a threshold amount of ink from said print cartridge;

checking a first temperature of the printhead;

determining a status of the print cartridge, based on the first temperature and independent of the amount of available ink; and if said determining step concludes that the print cartridge is at or near the end of useful life independent of said amount of available ink, sending a warning about the status of the print cartridge.

2. The method of claim 1, wherein said determining a status of the print cartridge step further comprise the steps of:

comparing said first temperature from said checking step with a maximum final temperature; and if said first temperature from said checking step exceeds said maximum final temperature, concluding that said print cartridge is at or near the end of useful life.

3. The method of claim 1, wherein said determining the status of the print cartridge step further comprises the steps of:

waiting a period of time after said expelling a threshold amount of ink, wherein during said period of time no ink is expelled from the printhead;

checking the first temperature of said printhead after said period of time;

comparing said first temperature from said checking step with a maximum final temperature; and if said first temperature from said checking step exceeds said maximum final temperature, concluding that said print cartridge is at or near the end of useful life.

4. The method of claim 1, wherein said determining the status of the print cartridge step further comprises the steps of:

checking the first temperature of said printhead after said threshold amount of ink is expelled;

while refraining from expelling ink from said printhead, measuring a period of time until said printhead has reached a second temperature;

comparing said period of time from said measuring step with a maximum period of time; and if said period of time from said measuring step exceeds said maximum period of time, concluding that said print cartridge is at or near the end of useful life.

5. The method of claim 1, wherein said checking a first temperature step further comprises the steps of:

measuring the resistance of a thermal sense resistor contained in said printhead; and reading a stored value of said thermal sense resistor from memory associated with said thermal sense resistor, said stored value representing a resistance value of the thermal sense resistor at a typical operating temperature.

6. The method of claim 5, wherein said stored value is determined during manufacture of said print cartridge.

7. A replenishable inkjet printing system, comprising a printer capable of receiving a print cartridge having a printhead and a supply of ink, the supply of ink being replenishable from another ink supply, said printer further comprising:

memory;

a processor connected to said memory, said processor further comprising a print cartridge end of life detector, said print cartridge end of life detector further comprising:

means for checking a first temperature of the printhead after a threshold amount of ink has been expelled from the printhead with the printhead installed in the printing system, wherein the supply of ink in the print cartridge is replenishable via another ink supply;

means for determining a status of the print cartridge, based on the first temperature and independent of an amount of ink available to the print cartridge; and if said determining means concludes that the print cartridge is at or near the end of useful life independent of the amount of ink available to the print cartridge, means for sending a warning about the status of the print cartridge.

8. The ink jet printing system of claim 7, wherein said means for determining a first temperature further comprises:

means for measuring the resistance of a thermal sense resistor contained in said printhead; and means for reading a stored value of said thermal sense resistor from memory associated with said thermal sense resistor, said stored value representing a resistance value of the thermal sense resistor at a typical operating temperature.

9. The ink jet printing system of claim 7, further comprising:

a computer, connected to said printer; and a display, connected to said computer;

wherein said warning is displayed on said display.

10. A print cartridge for an inkjet printing system, said print cartridge comprising:

an ink reservoir;

a printhead operatively coupled to said ink reservoir, the reservoir holding supply of ink which is replenishable from another ink supply located remotely from the print cartridge, said printhead comprising:

a temperature sensor for providing temperature information about said printhead to said printer after a threshold amount of ink is expelled from the printhead so that said printer can send a warning that the print cartridge is at or near the end of life, based on said temperature information and independent of an amount of ink available to the printhead.

11. The print cartridge of claim 10, wherein said temperature sensor further comprises:

a thermal sense resistor; and memory associated with said thermal sense resistor, said memory having a stored value representing a resistance value of the thermal sense resistor at a preselected temperature, wherein said stored value is determined during the manufacturing process of said print cartridge.

12. The print cartridge of claim 11, wherein the preselected temperature is a typical operating temperature of said printhead in said print cartridge.

13. A method of detecting an end of useful life of a print cartridge having a printhead, the print cartridge used in a replenishable printing system, the useful life being independent of the amount of available ink in the printing system for the printhead, the method comprising the steps of:

with the print cartridge installed in the replenishable printing system wherein a supply of ink in the print cartridge is replenished via another ink supply, expelling a threshold amount of ink from said print cartridge;

checking a first temperature of the printhead;

determining a status of the print cartridge, based on the first temperature and independent of the amount of available ink, comprising checking the first temperature of said printhead after said predetermined amount of ink is expelled;

waiting a period of time during which no ink is expelled from said printhead;

checking a second temperature of said printhead after said period of time;

checking an ambient temperature of said printer;

calculating a heat transfer efficiency of said printhead using said first temperature, said second temperature, and said ambient temperature; and if said heat transfer efficiency of said printhead is below a minimum heat transfer efficiency, concluding that said print cartridge is at or near the end of useful life; and if said determining step concludes that the print cartridge is at or near the end of useful life independent of said amount of available ink, sending a warning about the status of the print cartridge.

14. The method of claim 13, wherein said threshold amount of ink expelled by said expelling step is expelled into a service station in said thermal ink jet printer.

15. The method of Claim 13, wherein said threshold amount of ink expelled by said expelling step is expelled onto media.

16. The method of claim 13, wherein said warning is displayed on a display operatively coupled to said thermal ink jet printer.

17. The method of claim 13, wherein said warning is displayed on media readably by a user.

18. The method of claim 13, wherein said warning is displayed on a status panel contained on said thermal ink jet printer.

19. The method of claim 13, further comprising the step of:

if said determining step concludes that the print cartridge is not at or near the end of useful life, sending an informational message that the print cartridge has a portion of useful life remaining.

20. A method of detecting an end of useful life of a print cartridge having a printhead, the print cartridge used in a replenishable printing system, the useful life being independent of the amount of available ink in the printing system for the printhead, the method comprising the steps of:

with the print cartridge installed in the replenishable printing system wherein a supply of ink in the print cartridge is replenished via another ink supply, expelling a threshold amount of ink from said print cartridge;

checking a first temperature of the printhead, said checking comprising measuring the resistance of a thermal sense resistor contained in said printhead, and reading a stored value of said thermal sense resistor from memory associated with said thermal sense resistor, said stored value representing a resistance value of the thermal sense resistor at a typical operating temperature, said stored value determined during manufacture of said print cartridge;

determining a status of the print cartridge, based on the first temperature and independent of the amount of available ink; and if said determining step concludes that the print cartridge is at or near the end of useful life independent of said amount of available ink, sending a warning about the status of the print cartridge;

said method further comprising the process steps performed during manufacture of the print cartridge, said process steps comprising:

measuring the resistance of said thermal sense resistor at a known ambient temperature;

calculating a resistance value of the thermal sense resistor at a typical operating temperature higher than said known ambient temperature; and storing said stored value of said thermal sense resistor in said memory associated with said thermal sense resistor.

21. The method of claim 20, wherein said calculating step further comprises the steps of:

measuring a plurality of thermal coefficient of resistivity values for a corresponding plurality of thermal sense resistors contained in a corresponding plurality of print cartridge units;

averaging said plurality of thermal coefficient of resistivity values together to obtain an average thermal coefficient of resistivity value; and using said average thermal coefficient of resistivity value in said calculating step as a damping function to reduce effects of any one particular thermal sense resistor that has a thermal coefficient of resistivity value much higher or much lower than said average thermal coefficient of resistivity value.

* * * * *